United States Patent [19]

Mack et al.

[11] Patent Number: 4,602,143

[45] Date of Patent: Jul. 22, 1986

[54] INFRARED HAIR STYLING DEVICE

[75] Inventors: William Mack, Commack, N.Y.; Daniel Santhouse, Stratford, Conn.

[73] Assignee: Clairol Incorporated, New York, N.Y.

[21] Appl. No.: 671,344

[22] Filed: Nov. 14, 1984

[51] Int. Cl.[4] ..... H05B 1/02; H05B 3/00; A45D 1/04; A45D 2/36

[52] U.S. Cl. ..... 219/225; 34/3; 34/4; 128/396; 132/7; 132/9; 132/37 R; 219/230; 219/241; 219/343; 219/346; 219/358; 219/373; 219/377

[58] Field of Search ..... 219/222-226, 219/230, 241, 346, 358, 373, 377, 354, 258, 343; 132/7, 9, 11 R, 11 A, 31 R, 32 R, 34 R, 37 R, 37 A; 38/82; 34/3, 4; 128/395-398

[56] References Cited

U.S. PATENT DOCUMENTS

| | | | |
|---|---|---|---|
| 2,241,067 | 5/1941 | Holm-Hansen | 219/258 X |
| 2,357,905 | 9/1944 | Olving | 219/255 X |
| 2,364,730 | 12/1944 | Leskin | 219/346 X |
| 3,098,922 | 7/1963 | Paxton | 219/258 X |
| 3,423,572 | 1/1969 | Pansing | 219/358 X |
| 3,475,592 | 10/1969 | Berkl | 219/358 X |
| 3,515,853 | 6/1970 | McAdams | 219/358 X |
| 3,622,746 | 11/1971 | Trouilhet | 132/37 R |
| 4,314,137 | 2/1982 | Dorn | 219/222 |
| 4,354,093 | 10/1982 | Zago | 219/241 X |
| 4,430,808 | 2/1984 | Toyomi et al. | 219/373 X |

FOREIGN PATENT DOCUMENTS

| | | | |
|---|---|---|---|
| 2506074 | 8/1976 | Fed. Rep. of Germany | 219/222 |
| 2720961 | 11/1978 | Fed. Rep. of Germany | 219/222 |
| 2819725 | 11/1979 | Fed. Rep. of Germany | 219/346 |
| 907106 | 2/1982 | U.S.S.R. | 219/258 |

*Primary Examiner*—A. Bartis

*Attorney, Agent, or Firm*—G. Warzecha

[57] ABSTRACT

A curling iron provided with an infrared radiation source within a hollow barrel for radiating infrared radiation within a predetermined band. The barrel is substantially transparent to radiation within the band emitted by the source. The curling iron is provided with a hair clip for retaining hair wound about the barrel, the clip also being substantially transparent to this infrared band. A fan is provided for blowing cooling air past the infrared source and through the barrel, the tip of the barrel being sufficiently perforated to pass this cooling air. The curling iron is further provided with a circuit for energizing the infrared source in a predetermined cyclical manner in order to maintain the temperature of the barrel within a predetermined range. A temperature sensor is further provided to sense the temperature of the barrel in order to activate the control circuit accordingly.

3 Claims, 8 Drawing Figures

INFRARED HAIR STYLING DEVICE

BACKGROUND OF THE INVENTION

1. Field of the Invention

The invention relates generally to hair styling devices and in particular to handheld appliances used for the curling and setting of hair.

2. Description of the Prior Art

Handheld heatable curling irons and curling brushes are styling devices well-known in the art for setting curls in hair. The term "curling iron" is used generically here and in the art to mean devices as hereinafter described generally comprising a handle and a cylindrical hair winding portion or barrel or tube attached thereto for having hair wound thereon. While the term "curling iron" is used herein, it will be understood that the invention is equally applicable to curling brushes. The barrels are often made of aluminum or some other lightweight metal (having good thermal conductivity characteristics) and are provided with some means for heating the barrel. The barrels may be covered with some flocked material to facilitate gripping the hair and may be provided with bristles to to form a brush. The heating means of prior art curling irons may comprise an electrical resistance heater within the barrel or a self-contained catalytic heater, and in some devices the use of a temperature regulating means (for example, a PTC resistor) controls the temperature of the barrel. Selected hair tresses are wound around the barrel and heat is transferred by conduction from the heated barrel to the hair.

All known curling irons require hair tresses to be wound about the heated barrel and, therefore, the outer layers of hair are insulated from contact with the barrel surface by the inner layers. Regardless of the manner in which the barrel is heated, it is apparent that known prior art curling irons are conduction heating devices and have a tendency to heat and dry the inner layers of a hair tress before the outer layers. This often results in the user excessively heating and drying and therefore possibly damaging a portion of each tress in order to achieve the desired temperature for the outer layers.

Accordingly there is a need for a curling iron that can provide more uniform heating of hair. It has been found that irradiation of hair with electromagnetic radiation of a predetermined band in the infrared range achieves a desirable degree of uniform heating. Since the hair is randomly wound about the barrel of the curling iron with spaces between adjacent strands, radiant heating provides better energy transfer to the hair throughout the tress. The spacing between the inner strands permits the infrared radiation to penetrate through the hair tress to the outer layers which are then heated by the radiation as well as by conduction of heat from adjacent hair strands.

The use of infrared radiation of a predetermined wavelength on the order of 1 to 7 microns is known in bonnet-type hair dryers. Such a system is shown, for example, in French Pat. No. 1,150,093. Other bonnet-type hair dryers using infrared radiation are shown in U.S. Pat. Nos. 3,972,126, 4,259,566, 4,256,127 and 4,292,985. However, none of these prior art patents disclose the use of an infrared radiation source in a curling iron for the setting of curls and none of these patents disclose a handheld device. U.S. Pat. Nos. 4,323,761 and 4,263,500, assigned to the assignee hereof, do disclose handheld, radiant heat hair dryers using an infrared radiator and a fan for blowing air on the hair, however, neither of these devices are suitable for use in a curling iron.

Additional disadvantages of prior art curling irons is that they are very hot to the touch when in use (on the order of 140° F.) and retain this high temperature whether they are curling hair or merely waiting to be used, thereby producing some risk of injury to the user. Additionally, because of the resistive or catalytic heating elements and the transfer of heat energy by conduction, there is a rather long warm-up period required before prior art irons are ready for use. For example, a catalytic butane curling iron has been found to require on the order of 4 to 5 minutes to reach operating temperature. A unit utilizing a positive temperature coefficient (PTC) resistance heater requires on the order of 7 to 8 minutes and a "rope" heater on the order of 12 minutes.

Another disadvantage of prior art conduction curling irons is the fact that they do indeed retain whatever heat is transferred to the barrel for a considerable time. It is well known that better curls may be set in hair if the hair can be cooled while it is being set in the desired position. Since prior art conduction curling irons remain on once they are turned on, they must be removed from one hair tress while still hot so that the iron may be used to set another hair tress. Consequently, each hair tress must be allowed to cool in a relatively uncurled position since the curl starts to unwind as soon as the iron is removed.

Accordingly it is an object of this invention to provide a curling iron capable of heating and curling hair through radiation of infrared energy.

It is another object of this invention to provide a curling iron having a relatively cool barrel temperature at times when the iron is not on and operatively engaged with a hair tress.

It is another object of this invention to provide a curling iron which reaches operating temperature relatively quickly, on the order of seconds as opposed to minutes, so that it may be turned on for the curling of each hair tress and turned off after the curling of each hair tress.

It is another object of this invention to provide a curling iron for the radiation heating of hair to a predetermined temperature.

SUMMARY OF THE INVENTION

These and other objects of the invention are achieved by the preferred embodiment which comprises a curling iron having a handle, infrared transparent barrel, and an infrared radiation source positioned within the barrel for radiating infrared radiation within a predetermined wavelength band. The curling iron is further provided with a control circuit for energizing the infrared source in a predetermined manner in order to maintain the temperature of the barrel (and the hair) within a predetermined range. The circuit may be energized either in response to a sensor used for sensing the temperature of the barrel or the hair, or in response to a timing circuit designed to energize the circuit in a predetermined cyclical manner. The curling iron is further provided with a hair clip utilized in a conventional manner but which is also transparent to the infrared radiation.

DESCRIPTION OF THE PREFERRED EMBODIMENT

Figure 1:
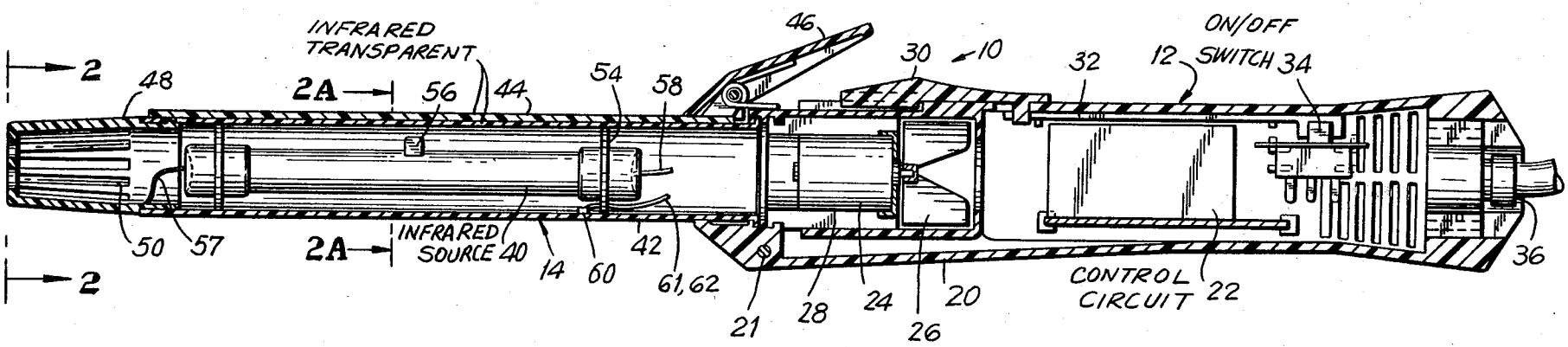
FIG. 1 shows a side elevation view in cross-section of a curling iron constructed in accordance with the principles of this invention.
Figure 2A:
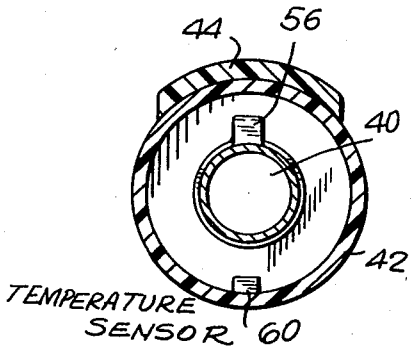
FIG. 2A shows a cross-section of FIG. 1 taken along line 2A—2A.
Figure 2:
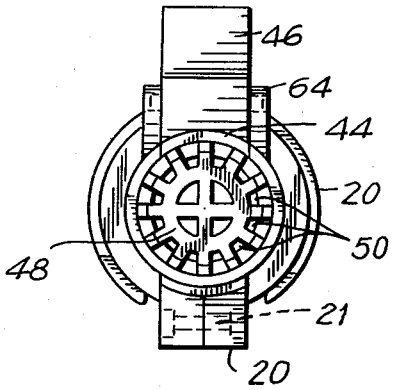
FIG. 2 shows a left end view of the curling iron shown in FIG. 1.

Referring now to FIG. 1 there is shown a side elevation cross-sectional view of a curling iron 10 constructed in accordance with the principles of this invention. Curling iron 10 comprises a handle portion 12 and a hair winding barrel portion 14.

Figure 4:
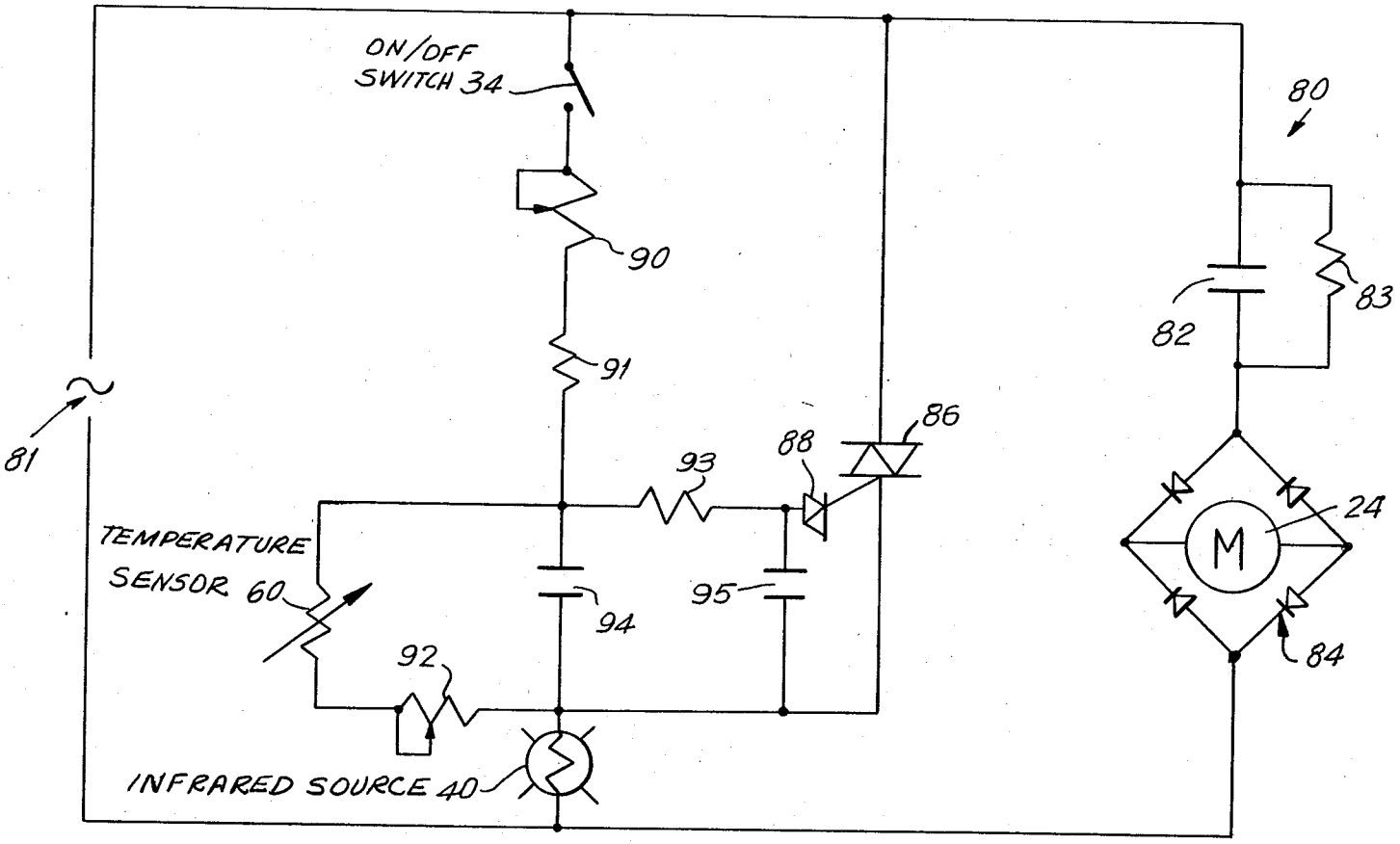
FIG. 4 is a schematic representation of the control circuit of the invention.

Handle portion 12 comprises an outer casing 20 constructed of a poor heat conductive material in order to inhibit the transfer of heat from the curling iron to the user. Casing 20 may be molded in two halves for being secured together by screws 21, each half molded with appropriate support ribs and other structures for supporting internal components within handle portion 12. Handle portion 12 further comprises a control circuit board 22 (the operation of which will be described below), a motor 24 and fan 26. Vanes 28 are provided adjacent motor 24 in order to enhance the air flow from fan 26. Handle portion 12 further comprises thumb button 30 connected by a switch actuating slider 32 to a conventional on/off switch 34 operatively connected to control circuit 22 and motor 24 as best seen in FIG. 4. Electrical power supplied to handle portion 12 through a swivel plug connection 36 which may be, for example, a swivel connection such as is shown in U.S. Pat. No. 3,950,052 assigned to the assignee hereof. (The electrical connections between the various electrical components of curling iron 10 are omitted for the sake of clarity.)

Barrel portion 14 comprises a longitudinally extending infrared radiation source 40 axially situated within barrel 42. Infrared source 40 is positioned axially within barrel 42 by means of lamp clips 52 and 54. The central axis of infrared source 40 may not exactly coincide with the axis of barrel 42 because of air evacuation nipple 56. If a source with such a nipple is used a slight off-centering may be desired to maintain clearance between nipple 56 and the interior of barrel 42 in order to avoid undesirable a spot heating of barrel 42. Infrared source 40 is connected to control circuit board 22 by wires 57 and 58 (merely diagrammatically shown) and is controlled in a manner described below.

Temperature sensor 60 is mounted in the interior of barrel 42, although not necessarily in direct contact with the internal surface, and is connected to control circuit board 22 by wires 61 and 62. Sensor 60 is situated near one end of infrared source 40 so as not to receive excessive direct infrared radiation which may produce erroneous temperature readings.

Figure 3A:
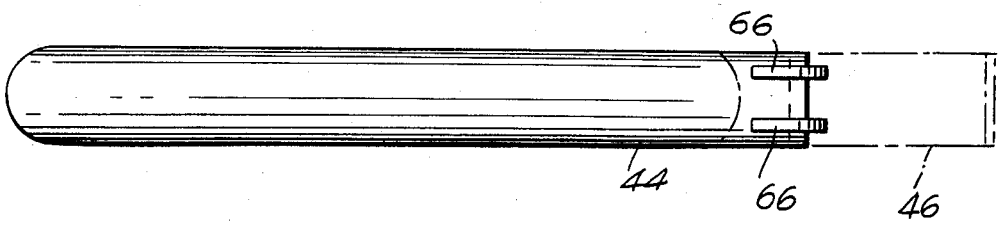
FIGS. 3A and 3B show more detailed top plan and side elevation views of the hair clip used with the curling iron shown in FIG. 1.
Figure 3B:
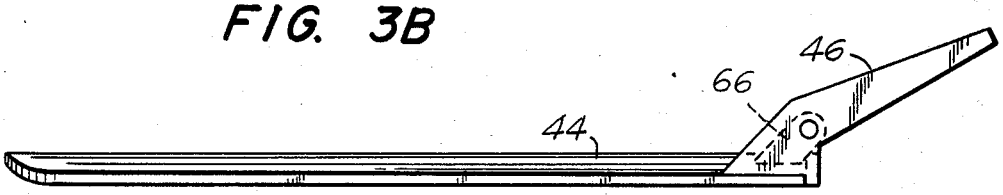
Figure 3C:
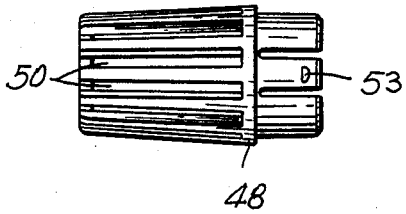
FIGS. 3C and 3D show more detailed side elevation views of the barrel and cap, respectively, used with the curling iron shown in FIG. 1.

A hair clip 44 having a handle 46 (best seen in FIG. 3A and 3B) is used to retain the hair adjacent barrel 42 in a conventional manner in order to facilitate winding of a hair tress. For clarity, handle 46 is shown in phantom in FIG. 3A. While hair clip 44 is conveniently described as being a part of barrel portion 14, it is in the preferred embodiment actually hinged to a pair of bosses 64 molded into the end of casing 20 adjacent barrel portion 14. Hinge brackets 66 molded near the end of clip 44 allow the clip to be pivotally attached to iron 10 by a hinge pin (not shown) passing through aligned apertures in bosses 64, brackets 66 and handle 46. Barrel portion 14 further comprises a slotted end cap 48 (best seen in FIG. 3C) secured to barrel 42 at the end opposite handle portion 12. Cap 48 is provided around its circumference with peripheral ventilation slots 50 and may be covered by a fine mesh screen (not shown) to further limit access to the interior of the barrel while enabling air blown by fan 26 to flow out.

Figure 3D:
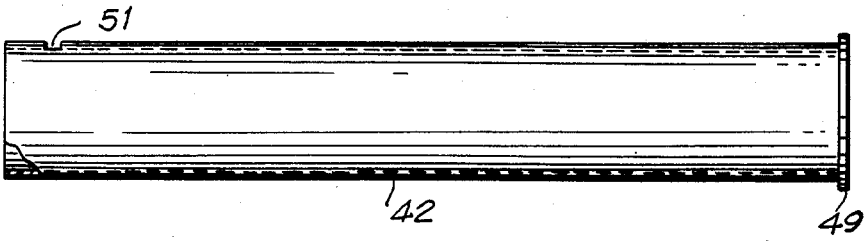

Referring now to FIG. 3D there is shown a side elevational view of barrel 42, respectively. Barrel 42 is made of a material that is ideally transparent to infrared radiation on the order of 1–7 microns, which band has been found absorptive by water. Barrel 42 is molded with a flange 49, for engagement with a corresponding recess in the two halves of casing 20, and has an aperture 51 for engagement with a complementarily shaped protrusion 53 molded into the base of end cap 48.

Referring now to FIG. 4 there is shown a schematic diagram of control circuit 80 used in the preferred embodiment to control the operation of curling iron 10. It will be noted that certain components shown in FIG. 4 (such as motor 24, on-off switch 34, temperature sensor 60 and infrared source 40) are mounted within curling iron 10 at the various locations previously described. The remaining components shown in FIG. 4 may be mounted on control circuit board 22 which may be, for example, a printed circuit board.

In the preferred embodiment motor 24 is a low voltage dc motor connected to an ac source 81 via a conventional filtering capacitor 82, resistor 83 and diode bridge 84. While in the embodiment shown motor 24 (and, consequently, the fan) is on as long as curling iron 10 remains plugged into an ac source, it will be understood that switch 34 could be, for example, a two position switch such that the first position would energize motor 24 and the second position would energize the infrared source 40. Motor 24 causes fan 26 to blow cooling air through barrel 42 to cool source 40 and barrel 42. While the barrel is substantially transparent to the band of infrared emitted by source 40, it may not be totally transparent and may absorb some radiation which will heat the barrel. Also, the heated hair will heat the barrel by conduction. Nevertheless, the barrel will stay substantially cooler with an infrared source than with conventional resistance or catalytic heaters.

Infrared source 40 is energized by circuit 80 by the closure of switch 34 which, in the preferred embodiment is a spring loaded switch which closes the circuit to source 40 only as long as the operator closes thumb switch 30. Switch 34, triac 86 and source 40 are connected in series across the ac line and the gate of the triac is connected to bilateral trigger diode or diac 88. Triac 86 serves as the switch to vary the load current to source 40 thereby regulating the power to source 40 and consequently the output of infrared radiation (while switch 34 is closed) as a function of the firing angle at the triac gate junction.

Variable resistor 90 and resistor 91 are in series with variable resistor 92 and temperature sensor 60 and the filter circuit comprising resistor 93 and capacitors 94 and 95. Resistor 92 reduces the sensitivity of circuit to resistance variations in sensor 60. Resistor 93 and capacitors 94 and 95 filter the input to diac 88 to prevent spikes which may cause spurious firing of triac 86. Sensor 60 may be for example a negative temperature coefficient resistor such as part No. PA51D1 supplied by Fenwal Inc., 251 Main Street, Ashland, MA 01721. As the resistance of sensor 60 varies as a function of temperature, the firing angle of triac 86, and consequently the length of time that source 40 is on, will vary thereby regulating the output of infrared radiation. The temperature sensed by sensor 60 is primarily a function of the length of time source 40 is energized, although the temperature of barrel 42 (as it may be affected by absorbed infrared radiation and heat conducted to the barrel from the hair) has some effect because the sensor is directed to sense the temperature of the barrel and the hair and is shielded from direct irradiation by source 40. Ideally, sensor 60 should sense the temperature of the hair wound upon barrel 42. However, as a practical matter, it has been found that there is a correlation between the temperatures of the barrel and the hair. Thus, triggering source 40 as a function of the temperature of barrel 42 is a convenient way to operate the circuit.

In operation, motor 24 is energized to cause fan 26 to blow cooling air through barrel 42 past source 40. Control circuit 80 energizes infrared source 40 once switch 34 is closed which would be done after a hair tress has been wound on the barrel. The cooling air serves to cool source 40 as well as barrel 42 thereby maintaining the external surface of the barrel at relatively low temperature to limit the conduction heating of a hair tress wound about the barrel and to prevent injury to the operator. Once sensor 60 reaches a predetermined temperature the input to diac 88 will fall below its avalanche point to turn off triac 86. Thus, it will be understood that within a predetermined temperature range infrared source 40 will cycle on and off. In the preferred embodiment it has been found that source 40 reaches the desired predetermined operating temperature range of 120° C. to 150° C. within 15 to 20 seconds. This compares quite favorably to the long heat-up times of prior art irons.

Alternatively, a control circuit may be devised without the use of a temperature sensor to merely cycle the source on and off at a predetermined rate calculated to keep the barrel temperature within certain limits. However, the use of a temperature sensor is preferred to provide a feedback loop to avoid cyclic unpredictable accumulation of heat in barrel 42.

It will be apparent to those skilled in the art that this invention could be embodied as a curling brush having a plurality of circumferentially arranged, radially extending rows of bristles. The brush could easily be manufactured of infrared transparent material and the operation of such a styling device would be similar to the preferred embodiment described herein. Additionally, various barrel cross-section shapes could be utilized: elliptical, polygonal, etc.

It will be obvious to those skilled in the art that numerous modifications and improvements may be made to the preferred embodiment of the invention disclosed herein within departing from the spirit and scope thereof.

What is claimed is:

1. A hair styling device comprising:

a hollow hair winding portion for having hair wound thereupon and a hair clip means for retaining hair adjacent said hair winding portion, both said hair winding portion and said hair clip means being substantially transparent to electromagnetic radiation within a predetermined range of wavelengths;

an electromagnetic radiation source within said hair winding portion for emanating radiation within said predetermined range;

energizing means operatively connected to said source for activating same;

control means operatively connected to said energizing means for intermittently activating said source in a predetermined manner, said control means further comprising a temperature sensor operatively connected to sense the temperature of said hair winding portion and said control means for maintaining the temperature of said hair winding portion within a predetermined range while said hair styling device is in use; and a handle means for supporting said hair winding portion, said hair clip means, said source, said enegizing means and said control means, said handle substantially aligned with said hair winding portion.

2. A hair styling device comprising:

a hollow hair winding portion for having hair wound thereupon, said hair winding portion being substantially transparent to electromagnetic radiation within a predetermined range of wavelengths;

an electromagnetic radiation source within said hair winding portion for emanating radiation within said predetermined range;

energizing means operatively connected to said source for activating same;

control means operatively connected to said energizing means for intermittently activating said source in a predetermined manner, said control means further comprising a temperature sensor operatively connected to sense the temperature of said hair winding portion and said control means for maintaining the temperature of said hair winding portion within a predetermined range while said hair styling device is in use;

a handle means for supporting said hair winding portion, said hair clip means, said source, said energizcontrol means, said handle substantially aligned with said hair winding portion; and a cooling means within said handle for cooling said source and said hair winding portion.

3. An apparatus according to claim 2 wherein said cooling means comprises a fan for blowing air through said hair winding portion.

* * * * *